US009517882B1

(12) United States Patent
Sawicki et al.

(10) Patent No.: US 9,517,882 B1
(45) Date of Patent: Dec. 13, 2016

(54) APPARATUS FOR COLLECTING WASTE MATERIAL IN A LARGE-SCALE INK-JET PRINTER

(71) Applicant: XEROX CORPORATION, Norwalk, CT (US)

(72) Inventors: Paul F Sawicki, Rochester, NY (US); Luis A Santiago, Rochester, NY (US); Piotr Sokolowski, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/164,023

(22) Filed: May 25, 2016

(51) Int. Cl.
*B65F 1/12* (2006.01)

(52) U.S. Cl.
CPC *B65F 1/125* (2013.01); *B65F 1/12* (2013.01)

(58) Field of Classification Search
CPC ..... B41J 2/1721; B41J 2/165232; B41J 2002/1735; B41J 2002/1742; B65F 1/12; B65F 1/141; B65F 1/1426; B65F 1/125
USPC ..... 232/43.5; 347/22, 35, 36
See application file for complete search history.

(56) References Cited

U.S. PATENT DOCUMENTS 6,164,752 A * 12/2000 Schaefer ..... B41J 2/16532 347/30
6,312,094 B1 * 11/2001 Ito ..... B41J 2/16523 347/22
6,357,853 B1 * 3/2002 Askren ..... B41J 2/16523 347/31
6,905,189 B1 * 6/2005 Duffield ..... B41J 2/16526 347/27
7,883,177 B2 * 2/2011 O'Neal ..... B41J 2/16585 347/31
7,922,307 B2 * 4/2011 Kobayashi ..... B41J 2/175 347/36
8,109,601 B2 * 2/2012 Takada ..... B41J 2/16523 347/32
8,469,488 B2 * 6/2013 Love ..... B41J 2/16585 347/36
8,764,157 B2 * 7/2014 Ozawa ..... B41J 2/20 347/19

* cited by examiner

*Primary Examiner* — William Miller
(74) *Attorney, Agent, or Firm* — Robert Hutter

(57) ABSTRACT

In a large-scale ink-jet printer with multiple rows of printheads, an apparatus collects waste material such as paper particles and excess ink. A set of trays is stacked vertically to correspond to the rows of printheads. Each tray includes a drain valve therein. The trays are mounted on a rack that is slidably mounted on a bracket. When the rack is lowered to a drain position on the bracket, a linkage on the rack engages a surface within the printer, such as on the bracket, and the linkage is pushed upward to open the valve associated with each tray. The opened valves cause the trays to drain out their waste material, ultimately to a collection container.

15 Claims, 4 Drawing Sheets

APPARATUS FOR COLLECTING WASTE MATERIAL IN A LARGE-SCALE INK-JET PRINTER

TECHNICAL FIELD

The present disclosure relates to an apparatus for collecting waste printhead material, such as excess ink and paper particles, from a large-scale ink-jet printer.

BACKGROUND

In a large-scale, high-volume ink-jet printer, particularly one in which printing is performed on a continuous web such as of paper, it is desirable to provide a subsystem for removing waste material from the area around the printheads. Such waste material that results from use of a large machine includes accumulations of dirt and paper particles, as well as ink that splashes around the machine during the printing process, or ink that bleeds from printheads when the machine is idle.

In printers that use caustic or otherwise harmful inks, such as UV-curable inks, it is also necessary that the collected waste ink and other materials are conveyed to a safe container for disposal, with minimal interaction by a human user.

SUMMARY

According to one aspect, there is provided an apparatus useful in printing, comprising a rack, the rack including a first tray and a second tray disposed above the first tray, the first tray and second tray each being suitable for collecting waste material from a printhead. The first tray and second tray each include a selectably-openable drain valve for draining waste material therefrom. A linkage is associated with the drain valve of the first tray and the drain valve of the second tray. The rack is selectably positionable within the apparatus in a drain position, whereby, in the drain position, the linkage presses against a surface within the apparatus and is thereby caused to open the drain valve of the first tray and the drain valve of the second tray.

DETAILED DESCRIPTION

Figure 1:
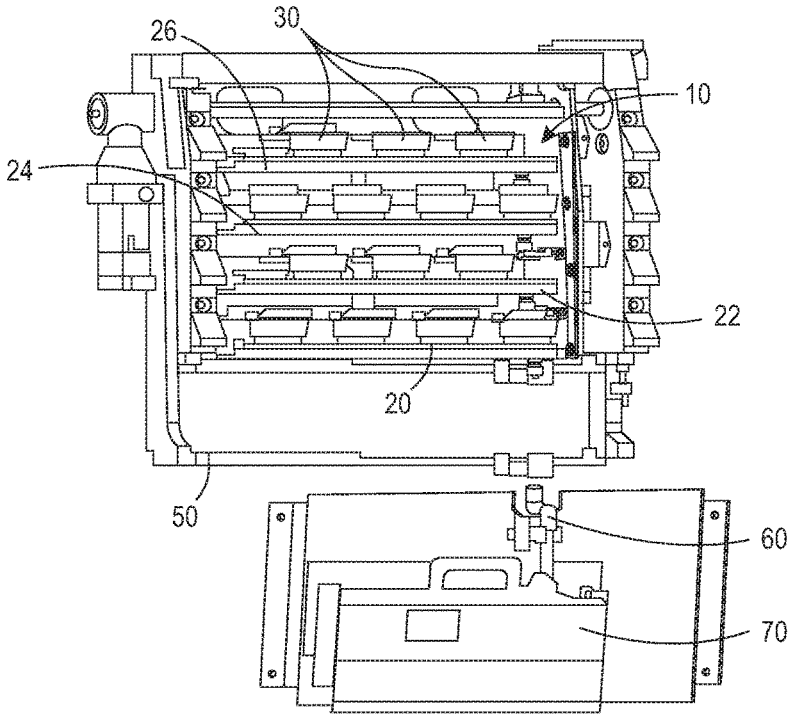
FIG. 1 and FIG. 2 are comparative, perspective views of a waste-collection assembly in first and second positions.
Figure 2:
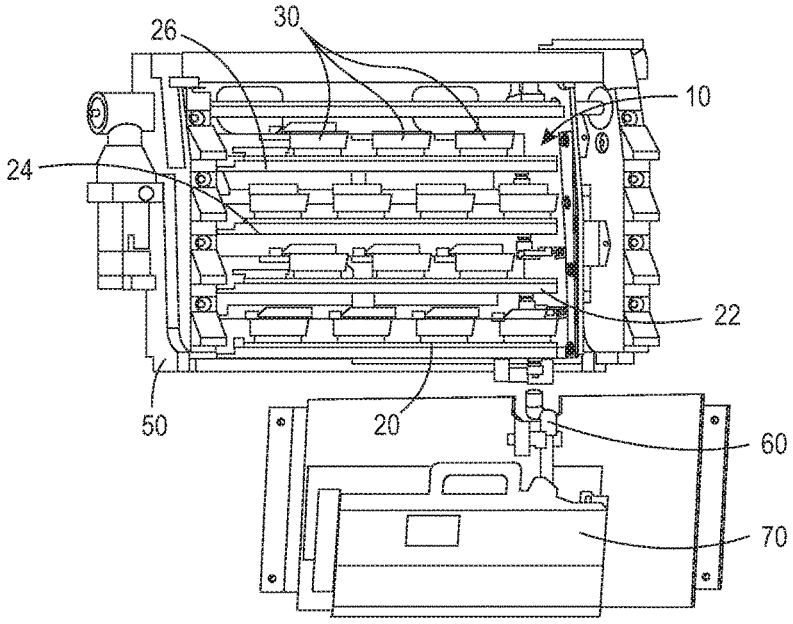

FIG. 1 and FIG. 2 are comparative, perspective views of a waste-collection assembly in first and second positions. Broadly, the assembly includes what can be called a rack 10, which is slidably mounted on a bracket 50. In FIG. 1, the rack 10 is disposed relative to bracket 50 in what can be called a "collecting" position, and in FIG. 2 the rack 10 is disposed relative to bracket 50 in what can be called a "drain" position.

In the illustrated embodiment, rack 10 includes a plurality of vertically-stacked, elongated trays 20, 22, 24, 26. Each tray includes thereon at least one chute 30, such as shown only with reference to tray 26 for clarity. In a particular embodiment, these chutes 30 will be selectably disposed, such as in the collecting position of FIG. 1, under individual printheads (not shown) in a large-scale printing apparatus. In a mode of operation of the printing apparatus (such as, but not necessarily, a purge or cleaning mode), waste material from the zones around the printheads will drop down each chute 30 and into one of the trays 20, 22, 24, 26. In the illustrated embodiment, the bracket 50 can be used to convey rack 10 horizontally into a collecting position relative to fixed printheads, and then out of the print path of the apparatus as needed. In various practical embodiments, a cleaning system for a printing apparatus may further include various structures such as wipers and brushes for removing waste material from the faces of the printhead: even in such a case, the wiped or brushed waste material will at some point be collected by one of the trays 20, 22, 24, 26.

The elongated trays 20, 22, 24, 26 accumulate waste material, typically waste ink and dirt and paper particles. At various times in the course of use of the printing apparatus, the trays will need to be emptied. Of course, it will be desirable to empty the trays 20, 22, 24, 26 in a manner that minimizes risk of spillage: if the apparatus uses a caustic or otherwise harmful ink such as UV-curable ink, it is further desirable that waste ink be collected safely in an enclosed container.

FIG. 2 shows the same elements as FIG. 1, with the rack 10 lowered, by means such as motors and/or tracks and pulleys, in a manner which will be apparent to one of skill in the art, down bracket 50 into what can be called the drain position. Disposed within the apparatus is a drain tube 60, which drains into a collection container 70. Collection container 70 is of a type that can be sealed for safe disposal when it is largely full. In overview, when rack 10 is lowered into its drain position, the various trays 20, 22, 24, 26, are emptied by gravity so that the waste material collected therein is drained ultimately trough drain tube 60 and into collection container 70.

Figure 3:
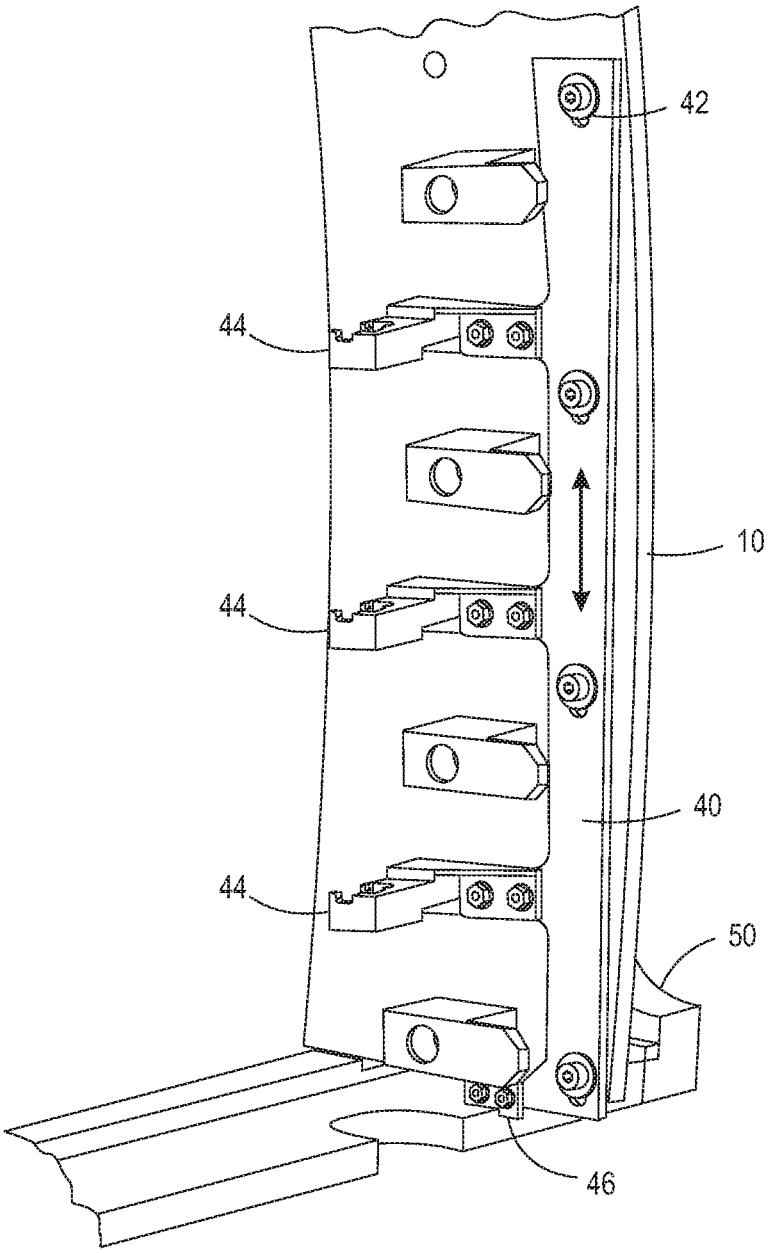
FIG. 3 is a perspective view showing a linkage mechanism, in isolation, by which one embodiment may carry out its objective.

FIG. 3 is a perspective view showing a linkage mechanism, in isolation, by which one embodiment may carry out its objective. A rigid linkage 40 is slidably mounted on a portion of rack 10, such as through extended bolt-holes 42 engaged by shoulder bolts as shown, so that the linkage may be moved vertically a short distance. The linkage 40 has rigidly attached thereto a set of fingers 44, each finger corresponding to a tray 22, 24, 26 in rack 10, in a manner which will be described below. The fingers are attached to linkage 40 either by rigid bolting as shown, or could be formed in one piece with linkage 40.

As can be seen in FIG. 3, when the rack 10 is disposed in its lowermost drain position on bracket 50, a bottom surface of linkage 40, which may include a special contact structure 46 as shown, contacts a surface of bracket 50, and is thereby pushed upward, in turn pushing each finger 44 upward. In effect, the force (either from a motor and/or pulley or track, not shown, or to some extent gravity) that pushes the rack 10 on bracket 50 also pushes the linkage 40 upward when the rack 10 is in the drain position.

Figure 4:
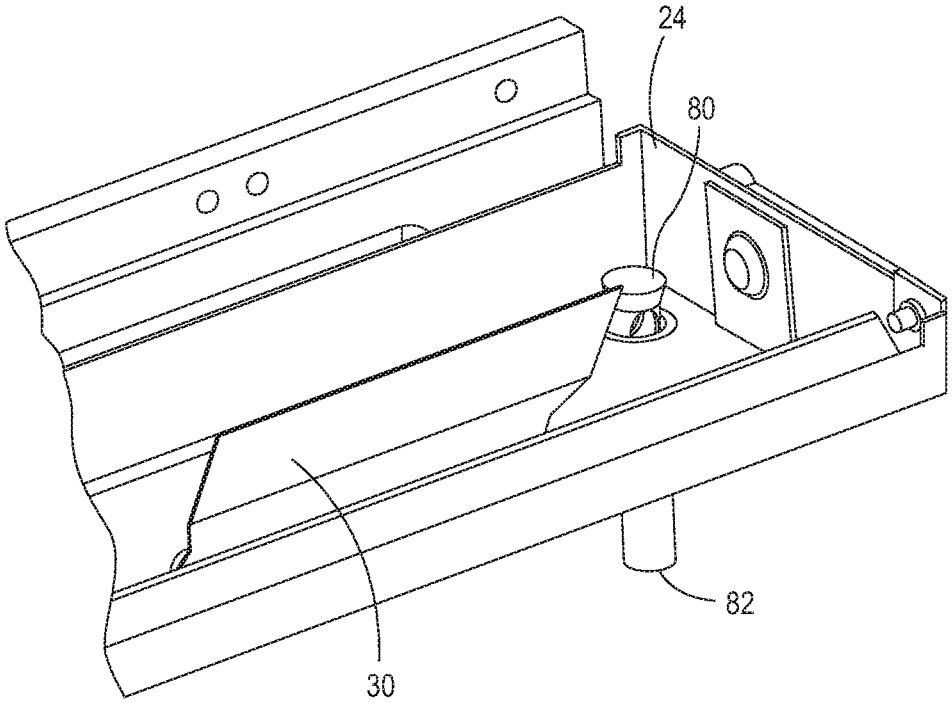
FIG. 4 is a perspective view of a portion of a single tray, showing a draining operation.

FIG. 4 is a perspective view of a portion of a single tray, in this case 24, showing a draining operation. (A representative chute 30 is visible in the Figure as well.) Disposed in an opening formed at the effective bottom of tray 24 is a valve 80, a further portion of which, drop tube 82, can be seen at the bottom of the Figure. As will be described below, when drop tube 82 of valve 80 is pushed upward, the valve 80 is pushed into the main cavity of tray 24, exposing an inlet opening 84. In such a position, flowable waste material (such as liquid waste ink with solid waste particles therein) will drain out of tray 24, and through inlet opening 84 and drop tube 82 of valve 80.

Returning to FIG. 3, it can be seen that, when rack 10 is in the drain position, the linkage 40 thereon is moved upward, causing fingers 44 to move upward. Because each finger 44 is disposed adjacent to or in light contact with a drop tube 82 or other part associated with a valve 80 for each tray 22, 24, 26, the linkage 40 causes all the drop tubes 82 of valves 80 to be pushed upward, causing all valves 80 to open, and each tray 22, 24, 26 to drain out the waste material therein, ultimately to bottom tray 20 (which may have its own, separate, valve system), through drain tube 60 and into collection container 70. In the embodiment shown in FIG. 2, each tray 22, 24, 26 drains into the tray immediately below, but in alternate embodiments, one or more trays could have dedicated tubes or other more direct drain paths into collection container 70.

Figure 5:
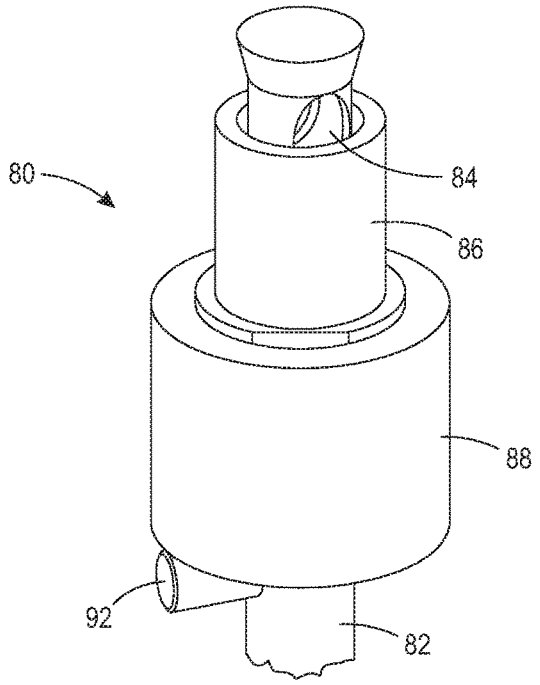
FIG. 5 is an isolated view.
Figure 6:
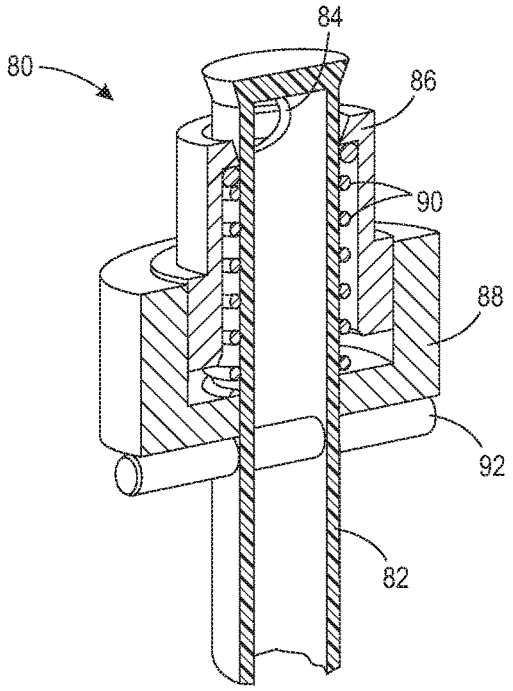
FIG. 6 is a perspective cross-sectional view, of a type of spring-loaded valve, with drop tube, that can be used in one embodiment.

FIG. 5 is an isolated view, and FIG. 6 is a perspective cross-sectional view, of a type of spring-loaded valve, with drop tube, that can be used in the present embodiment, although other types of valve are useable. As can be seen, drop tube 82 with inlet opening 84 is vertically movable relative to seal flanges 86, 88 (which themselves form a seal around an opening in a tray such as 24, particularly at the top shoulder of flange 86). A coil spring 90 naturally biases drop tube 82 downward, into a closed, sealed position; an upward push of drop tube 82 or flange 88, such as by a finger 44, will thus be against the spring force. A stop pin 92 or retaining ring (not shown) can restrict downward motion of the flange 88 beyond a certain point; this will maintain a pre-load on the spring 90, ensuring that the drop tube 82 is normally closed; and holds the valve assembly 80 together.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An apparatus useful in printing, comprising:

a rack, the rack including a first tray and a second tray disposed above the first tray, the first tray and second tray each being suitable for collecting waste material from a printhead, the first tray and second tray each including a selectably-openable drain valve for draining waste material therefrom;

a linkage associated with the drain valve of the first tray and the drain valve of the second tray;

the rack being selectably positionable within the apparatus in a drain position, whereby, in the drain position, the linkage is pushed against a surface within the apparatus and the pushing causes the linkage to open the drain valve of the first tray and the drain valve of the second tray.

2. The apparatus of claim 1, further comprising a mounting bracket, the rack being slidably mounted on the mounting bracket.

3. The apparatus of claim 2, wherein the rack is positioned in the drain position when the rack is slid to a bottom position on the mounting bracket.

4. The apparatus of claim 2, wherein the drain valve of the first tray is configured to drain waste material from the first tray to a collection bottle when the rack is slid to a bottom position on the mounting bracket.

5. The apparatus of claim 3, wherein, when the rack is at the bottom position, the linkage presses against a surface of the mounting bracket to open the drain valve of the first tray and the drain valve of the second tray, the surface of the mounting bracket being the surface within the apparatus.

6. The apparatus of claim 1, wherein the linkage is slidably mounted on the rack.

7. The apparatus of claim 1, wherein the drain valve of the second tray is configured to drain waste material from the second tray to the first tray.

8. The apparatus of claim 7, wherein the drain valve of the first tray is configured to drain waste material from the first tray to a collection bottle.

9. The apparatus of claim 1, the drain valve of at least one of the first tray and the second tray including a drop tube, the drop tube including an inlet opening, whereby, when the drain valve is opened, the drop tube is positioned upward into the tray, thereby permitting waste material to pass through the inlet opening and downward through the drop tube.

10. The apparatus of claim 9, the linkage being configured to move the drop tube upward as a result of the linkage being pushed against the surface within the apparatus.

11. The apparatus of claim 1, wherein at least one of the first tray and the second tray includes a chute for directing waste material from the printhead.

12. An apparatus useful in printing, comprising:

a rack, the rack including a first tray and a second tray disposed above the first tray, the first tray and second tray each being suitable for collecting waste material from a printhead, the first tray and second tray each including a selectably-openable drain valve for draining waste material therefrom;

a mounting bracket, the rack being slidably mounted on the mounting bracket;

a linkage associated with the drain valve of the first tray and the drain valve of the second tray, the linkage being slidably mounted on the rack;

the rack being selectably positionable on the mounting bracket in a drain position, whereby, in the drain position, the linkage is pushed against a surface within the apparatus and the pushing causes the linkage to open the drain valve of the first tray and the drain valve of the second tray;

wherein the drain valve of the second tray is configured to drain waste material from the second tray to the first tray, and the drain valve of the first tray is configured to drain waste material from the first tray to a collection bottle.

13. The apparatus of claim 12, the drain valve of at least one of the first tray and the second tray including a drop tube, the drop tube including an inlet opening, whereby, when the drain valve is opened, the drop tube is positioned upward into the tray, thereby permitting waste material to pass through the inlet opening and downward through the drop tube.

14. The apparatus of claim 13, the linkage being configured to move the drop tube upward as a result of the linkage being pushed against the surface within the apparatus.

15. The apparatus of claim 12, wherein at least one of the first tray and the second tray includes a chute for directing waste material from the printhead.

* * * * *